US007669550B2

(12) United States Patent
Henninger et al.

(10) Patent No.: US 7,669,550 B2
(45) Date of Patent: Mar. 2, 2010

(54) APPLICATION DEVICE

(75) Inventors: Christoph Henninger, Heidenheim (DE); Horst Kaipf, Lauingen (DE); Martin Schaubmaier, Rohrbach (AT); Michael Heitzinger, Linz (AT); Ruediger Keinberger, Aigen (AT)

(73) Assignee: Voith Patent GmbH, Heidenheim (DE)

( * ) Notice: Subject to any disclaimer, the term of this patent is extended or adjusted under 35 U.S.C. 154(b) by 1016 days.

(21) Appl. No.: 11/147,119

(22) Filed: Jun. 7, 2005

(65) Prior Publication Data

US 2005/0284364 A1 Dec. 29, 2005

(30) Foreign Application Priority Data

Jun. 16, 2004 (DE) ..... 10 2004 028 755

(51) Int. Cl.
*B05C 1/04* (2006.01)

(52) U.S. Cl. ..... 118/413; 118/414; 118/110; 118/126

(58) Field of Classification Search ..... 118/110, 118/126, 413, 414; 101/363, 425; 162/281; 427/356, 358

See application file for complete search history.

(56) References Cited

U.S. PATENT DOCUMENTS 3,980,043 A * 9/1976 Pomper ..... 118/60
5,284,551 A * 2/1994 Beran et al. ..... 162/353
5,738,726 A * 4/1998 Kaipf et al. ..... 118/410
2002/0172771 A1* 11/2002 Damrau ..... 427/355

FOREIGN PATENT DOCUMENTS

DE 296 17 230 10/1996
DE 202 13 757 9/2002

* cited by examiner

*Primary Examiner*—Laura Edwards
(74) *Attorney, Agent, or Firm*—Taylor & Aust, P.C.

(57) ABSTRACT

A device for applying a medium in the form of a liquid or a paste to a moving substrate, the substrate being a surface of a web of paper, a paper board, fibrous material and/or a transfer element including an application chamber, a first element, a second element and at least one limiting element. The first element is associated with the application chamber on an output side of the application chamber in a direction of movement of the moving substrate. The second element is associated with an input side of the application chamber. The at least one limiting element is associated with a lateral end of the application chamber. The at least one limiting element adjusting a width of application of the medium on the moving substrate. The at least one limiting element having a flexible sealing plate that substantially seals a space between the moving substrate, the first element and the second element. The sealing plate includes a fitted wearing body that is directed toward the moving substrate, with the wearing body being proximate to the first element and the second element.

7 Claims, 6 Drawing Sheets

APPLICATION DEVICE

BACKGROUND OF THE INVENTION

1. Field of the Invention

The present invention relates to a device for applying a medium in the form of a liquid or a paste to a moving substrate, and, more particularly to a device for applying a medium in the form of a liquid are parts to the surface of a web of paper, board, some other fibrous material or to the surface of a transfer element which conveys the application medium to the web of fibrous material.

2. Description of the Related Art

There are limiting elements that are already familiar from the state of the art, that limit the amount of medium that is applied to an edge of a fibrous web, which are also referred to as edge limiters or even as format limiters. As their name indicates, they are intended to establish a coating-free edge and a specific format or application width on the moving web of fibrous material during its manufacture and/or processing, these limiting amounts are beset with various disadvantages, such as contact with the moving substrate, which can at least partially damage a limiting element on the web by the high friction.

In addition, particles dissolved from the raw material of the web of fibrous material and/or from the application medium can be deposited on the sealing plate. These particles have an abrasive effect which can lead to damage to the moving substrate, that is to say, the web of fibrous material itself and/or the roller which supports it. In the event that the moving substrate is an application roller, damage can also occur to the roller cover. Mention must also be made of damage to the scraper element that is used for the metering and/or evening out of the applied application medium. In particular if the scraper element is a circular cylindrical scraper bar, rotating in a scraper bed, this will lead to local dry running with the negative consequences of damage to the outer surface of the scraper bar and a reduction in the associated quality of the application layer.

What is needed in the art is an improved application device in which the disadvantages associated with the state of the art are avoided.

SUMMARY OF THE INVENTION

The present invention comprises, in one form thereof, an application chamber, which, in relation to the direction of movement of the moving substrate, is limited by an element, for example a scraper element, at least on the output side, and by a further element, for example a retaining strip or a further scraper element, on the input side. The application chamber exhibits, on its lateral edge, a limiting element for adjusting the width of application, in conjunction with which the limiting element is provided with a flexible sealing plate, which essentially seals the space between the moving substrate and the elements on the output side and the input side.

An application device of this kind is designated in the technical terminology as an SDTA, i.e. Short Dwell Time Applicator, that is to say an application device with a short action time for the application medium.

The application medium used is coating dye, glue, sizing, an impregnation medium or the like, which is applied in an application chamber and is brought immediately thereafter to the desired coating weight.

The sealing plate is executed in accordance with the present invention in such a way that it presents a fitted wearing body facing towards the moving substrate and the scraper elements on the outlet side and the inlet side or the retaining strip.

The surfaces of the moving substrate and also those of the scraper elements, in particular the scraper element arranged on the outlet side, which performs the metering and/or evening out of the coating dispensed from an application chamber and applied to the moving substrate, are protected. This protection significantly increases the service life of these components.

The moving substrate, in the case of direct application, is a web of paper, board or fibrous material, which passes partially around a support roller or a backing roller. In the case of indirect application, the moving substrate is a transfer element, which subsequently conveys the application medium applied to it, to the web of fibrous material. A roller is generally used as the transfer element, that is to say an application roller having a roller cover that is protected by a wearing body, in accordance with the present invention, in the vicinity of the peripheral limiting elements of the coating.

The present invention lends itself particularly well to use with the so-called "Speedsizer" or "Speedcoater". These coating machines coat a web of fibrous material, as described above, by indirect means, in that two applicator rollers together form a gap, through which the web of fibrous material runs. The web of fibrous material exhibits an edge that is free from the coating on both sides. This coating-free edge is desirable from the point of view of preventing the spray of the application medium from drifting into the surrounding area, and it can be achieved with the limiting elements that are used, which are capable of being displaced transversely to the moving web in an appropriate fashion. The limiting elements remain in their initially set position during the operation. The limiting elements are also used to determine the format or the desired application width over the width of the web. The limiting elements are also capable of being changed with respect to their position. Adjustment to the width of the web in each case is possible in this way.

The wearing body, in accordance with the present invention, that is applied to a limiting element, and more accurately to the sealing plate of a limiting element, exhibits only low amounts of friction. Taking up or releasing particles with an abrasive effect is prevented, and a uniform application layer of high quality is achieved in this way.

An appropriate design of the wearing body, in accordance with the one embodiment of the present invention, requires this to be more wear-resistant, more dimensionally stable and more heat-resistant relative to the other flexible material of the sealing plate. This results in the entire limiting element achieving a higher service life than previously.

In the context of the present invention, it is proposed to attach the wearing body to the rest of the material of the sealing plate by gluing, welding, screwing, riveting, pressing-in or molding-in. The wearing body is also interchangeable, with regard to some of these methods of attachment, which increases the service life of the limiting element.

Rubber, cellular rubber, polyurethane or the like are envisaged as a material for the sealing plate. Thermoplastics such as polyethylene, polyester or polymers such as polyurethane, ceramics or mixtures of materials such as rubber with graphite, or even bearing metals such as bronze, can be used as a material for the wearing body in the present invention. The materials for the wearing body are characterized by their dimensional stability, heat resistance and, above all, a low coefficient of friction.

The wearing body, in accordance with an embodiment of the present invention, can exhibit a surface of a different design. Consequently, the surface of the wearing body, facing towards the moving substrate or towards the applicator roller, can be of a flat or curved form. It can also exhibit an inclined roof-like form, or the surface can be provided with slot-shaped incisions.

Additionally or alternatively, the surface of the wearing body can be provided with a chamfered or rounded edge facing towards the element arranged on the outlet side or the inlet side, such as the retaining strip or another scraper element. These possible embodiments are not restricted solely to the aforementioned embodiments, but other possibilities are conceivable, which permit the application medium, removed by the metering scraper element, to flow away and avoid the need for sharp edges to be in contact with the moving substrate.

The invention is described below in greater detail with reference to an illustrative embodiment.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
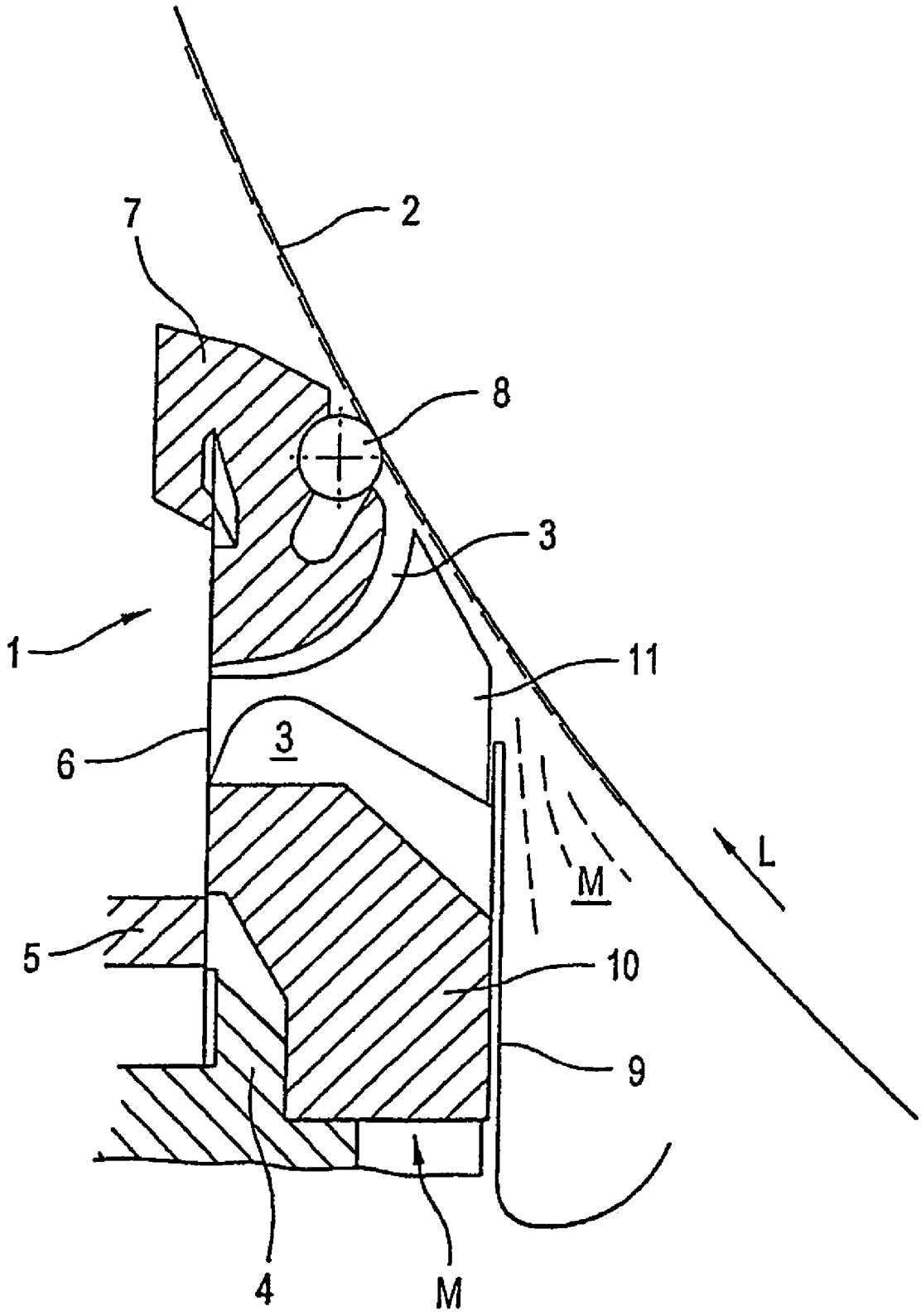
FIG. 1 is a schematic side view of an application device with a lateral limiting element and a sealing plate in accordance with the state of the art.

Referring now to the drawings, an application device 1 that is already familiar from the state of the art is represented in FIG. 1.

This device 1 is associated with a substrate 2 moving in a direction of movement L. In the case of direct application, substrate 2 is the web of fibrous material itself, and in the case of indirect application it is, for example, an application roller. The application roller transfers application medium M, dispensed from application device 1, in a section of the roller not represented here, onto a web of fibrous material having a width of up to 10 m and more, also not visible here, made of paper or board.

In the case of device 1, this is a so-called short dwell time applicator, because application medium M, that is applied to the moving substrate in an application chamber 3, is removed immediately by scraping. For example it is brought to the desired coating weight or is evened out, in an equalized, immediate fashion.

Device 1 consists of a supporting beam 4, adapted to the width of the web of fibrous material, and a clamping strip 5. Between clamping strip 5 and supporting beam 4 there is clamped a blade-like foot strip 6, which in turn carries a scraper bed 7 to accept a rotating, circular cylindrical scraper bar as a scraper element 8. Element 8 is arranged at the outlet end of application chamber 3. This is the end at which moving substrate 2 departs or moves away from application chamber 3. It is appropriate for the opposite end of application chamber 3 to be the end of the application chamber 3 on the inlet side or the outlet side, that is to say where substrate 2 moves toward application chamber 3. A further element 9 is accordingly arranged at the end on the inlet side in order to limit this chamber 3. A retaining strip 9 is provided for this purpose in FIG. 1. However, a scraper element of the kind designated with the number 8 with a scraper bed 7 and a foot strip 6 could find an application as an element 9 in place of retaining strip 9.

Application chamber 3 is limited in respect of its length, this corresponds to a section through the width of device 1 or moving substrate 2, by lateral limiting elements 10, which are also designated as format limiters, because these determine the application width B of the coating applied with application medium M and permit a corresponding, permanently coating-free edge. An adaptation to the existing width of the web of fibrous material is also possible in conjunction with this.

Limiting elements 10, each of which is arranged on the lateral edge of the substrate, are installed in a fixed position, although they can also be installed in such a way as to be capable of being displaced towards the middle and to the outside. Additional sealing plates 11 are used to seal application chamber 3, in conjunction with which every limiting element 10 is provided with a flexible sealing plate 11. Flexible sealing plate 11 consists of a sealing material, such as rubber, cellular rubber or even polyurethane, formed in a single piece.

When operating device 1, at the high machine speeds of ca 2000 m/min that are customary at the present time, contact cannot be avoided between sealing plate 11 and the closely associated component parts, such as moving substrate 2 and scraper element components 7 and 8 and retaining strip 9 present on the inlet side (which can also be omitted and replaced by an additional scraper element for the purpose of limiting application chamber 3), as a result of which these aforementioned component parts are exposed to damage due to the high friction. Substrate 2 is affected by this to a particularly high degree. In the case of indirect application, where the substrate is executed as an application roller, the roller surface (the cover of the application roller) is particularly at risk.

Wearing bodies have been developed for this reason within the scope of the present invention, which are placed on the flexible sealing strips or sealing plates and thus significantly extend the service life of the aforementioned component parts that are exposed to damage.

Figure 2:
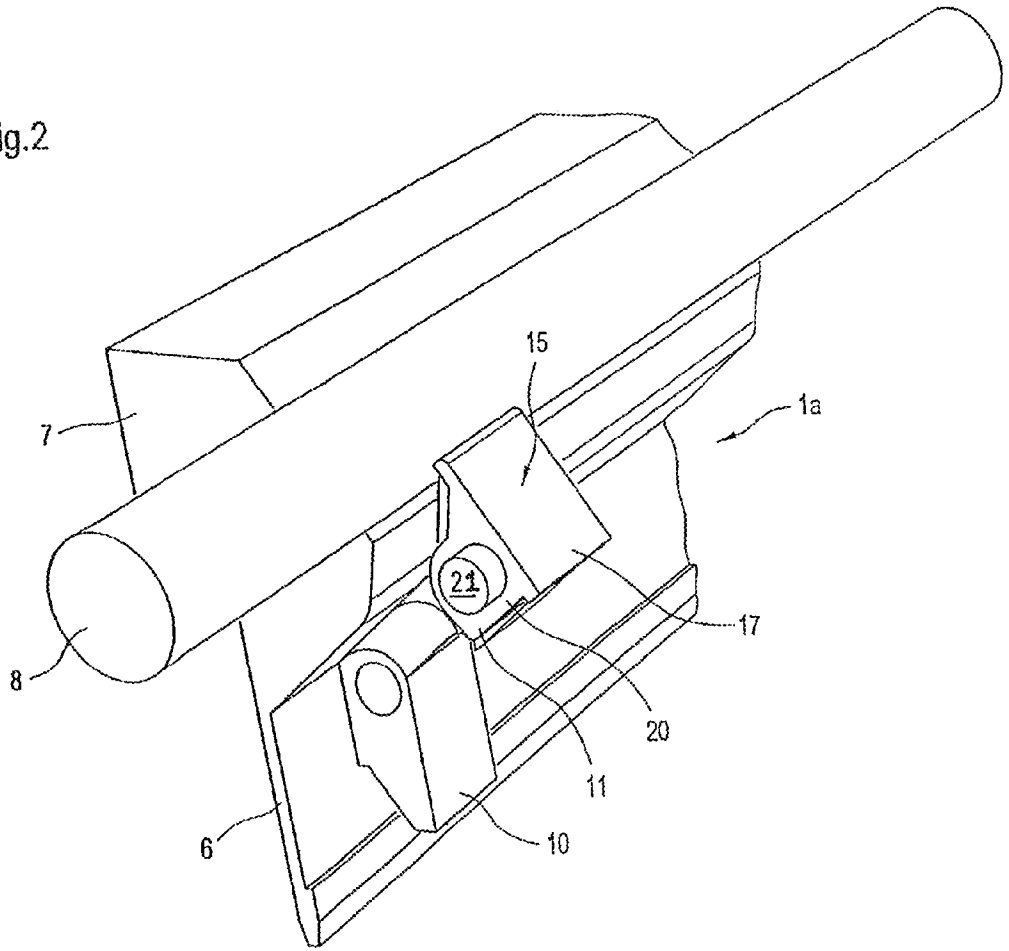
FIG. 2 shows a perspective representation of the device in accordance with an embodiment of the present invention with a limiting element, a sealing plate and a wearing body.

In FIG. 2, a device 1*a* of this kind in accordance with an embodiment of the present invention is represented in a perspective view, in which sealing plate 11 has been equipped with the aforementioned wearing body 15. In other respects, this exhibits the same component parts as the device that is already familiar from the state of the art as disclosed in FIG. 1, for which reason the repetition of details of its construction is dispensed with here.

Special embodiments of surface 17 of wearing body 15 facing towards the moving substrate (not shown here) can be appreciated from FIGS. 3 to 6.

Figure 3:
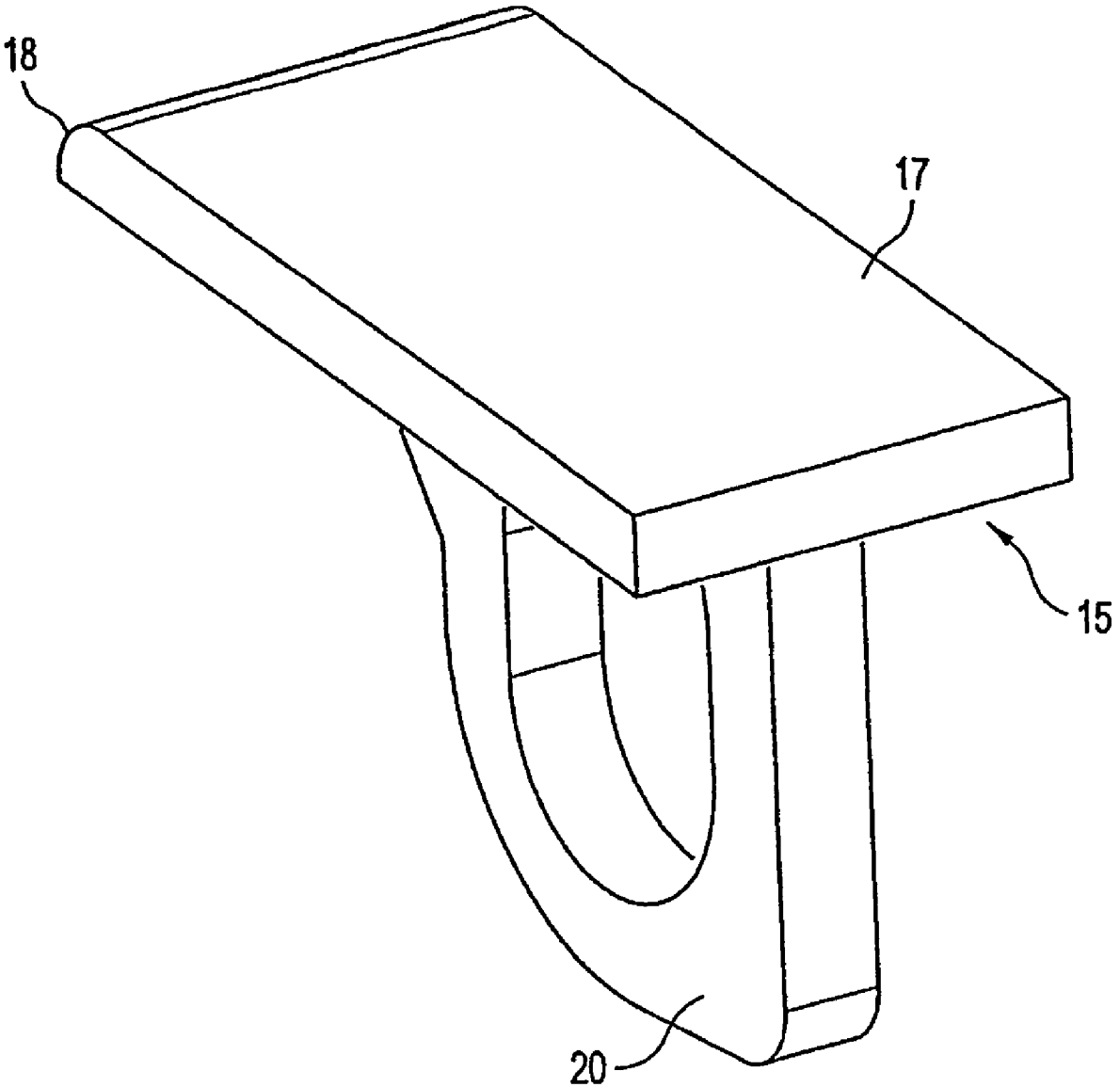
FIGS. 3-6 show various embodiments of the wearing body of FIG. 2.

Now, additionally referring to FIGS. 2 and 3, there is shown a flat surface 17 with a rounded edge 18 facing towards the substrate. Edge 18 is capable of making contact with the external surface of rotating scraper bar 8 without grounds for concern.

A bracket 20, for wearing body 15, is formed beneath surface 17 providing a way of attachment to sealing plate 11 and/or limiting element 10. The connection can be supplemented with a bolt 21 capable of being inserted into bracket 20.

Figure 4:
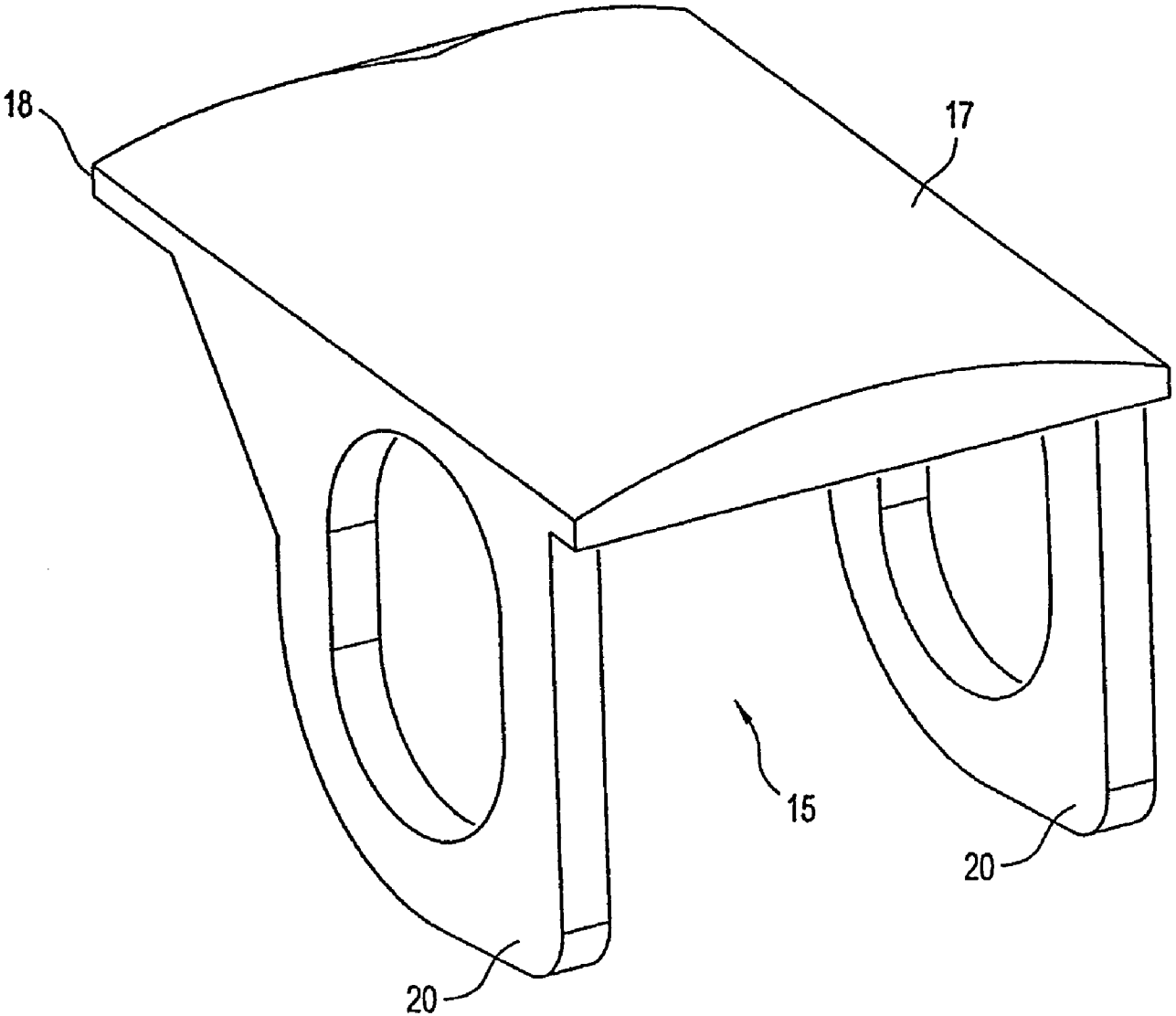

Now, additionally referring to FIG. 3, there is illustrated a bracket 20. Two brackets 20 are arranged at a distance from one another as illustrated in FIG. 4. In addition, wearing body 15 exhibits a curved surface 17.

Figure 5:
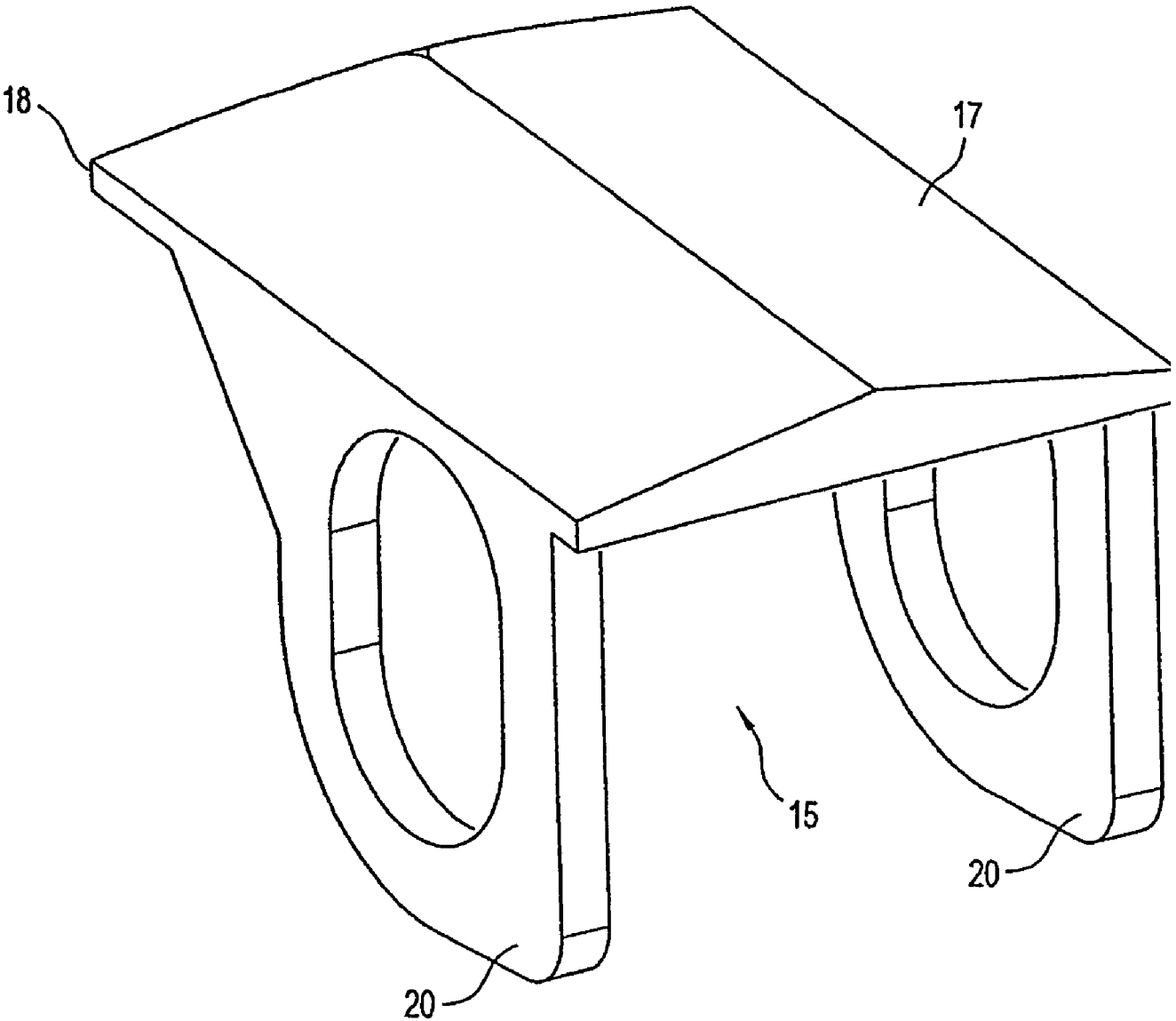
Figure 6:
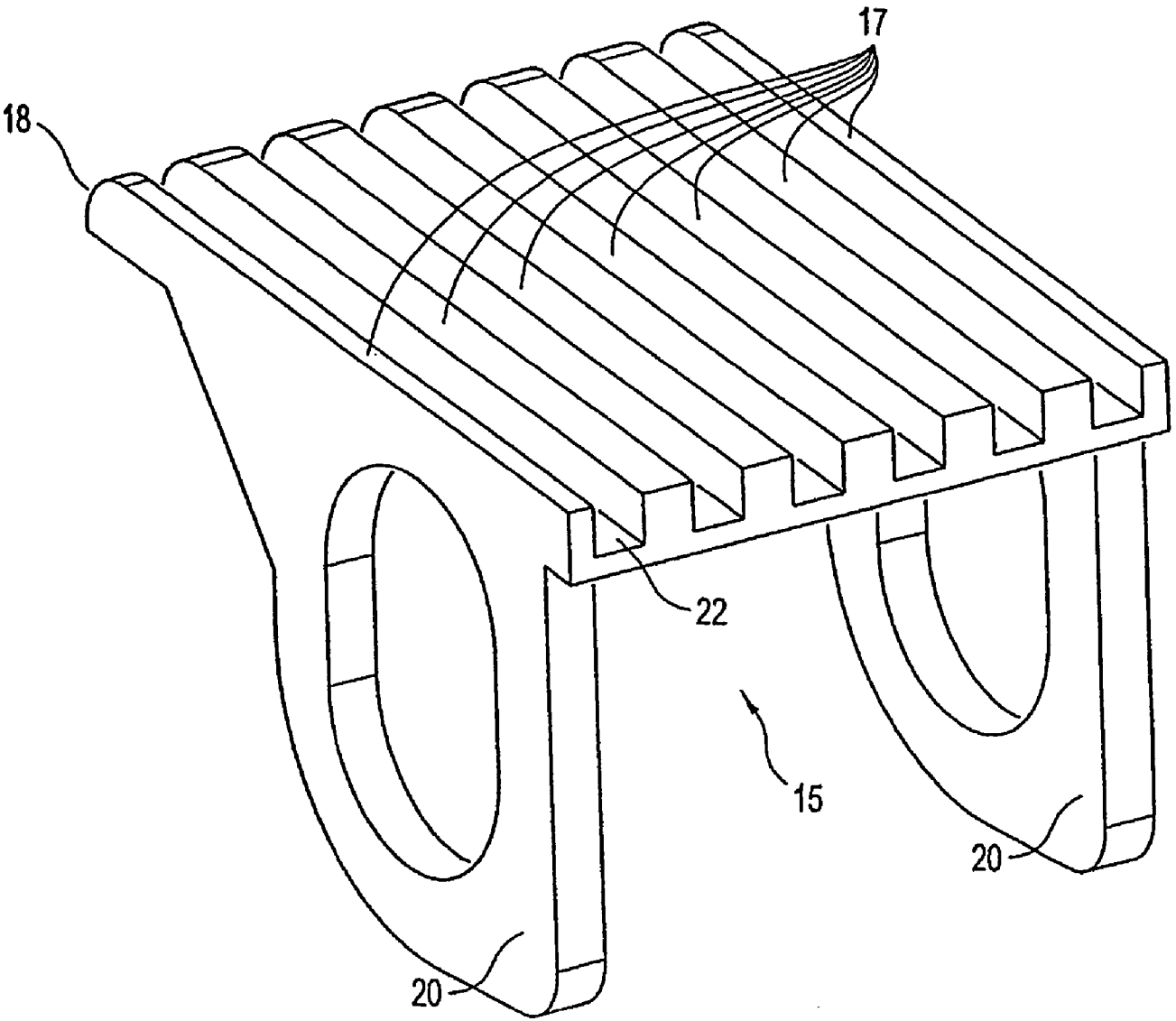

Now, additionally referring to FIGS. 5 and 6 there is illustrated other embodiments of the present invention, which correspond more or less to the embodiment in FIG. 4, but exhibit surface forms of different execution. FIG. 5 shows a surface 17 with an inclined roof-like form, and FIG. 6 represents a surface provided with slot-shaped incisions 22. These surface forms are suitable, on the one hand, to form the smallest possible contact surfaces with moving substrate 2, and on the other hand, to guarantee the best possible lateral sealing conditions for application medium M in application chamber 3.

Wearing body 15 can be attached to the rest of the material of sealing plate 11 by gluing, welding, screwing, riveting, pressing-in or molding-in. Wearing body 15 is also interchangeable in some of these methods of attachment, which serves to increases the service life of limiting element as a whole.

Rubber, cellular rubber, polyurethane or the like are envisaged as a material for limiting element 10 and sealing plate 11. More wear-resistant materials such as thermoplastics consisting of polyethylene, polyester, or also ceramics or mixtures of materials such as rubber with graphite, or even so-called bearing metals such as bronze, can be used as a material for wearing body 15. The materials used for wearing body 15 are characterized by their dimensional stability, heat resistance and, above all, a low coefficient of friction.

It should also be mentioned once again that the wearing body is suitable for use not only in device 1*a*, represented here as an SDTA device, but that it can also be used on the previously disclosed flexible format slides, which limit the length of the metering gap of free-jet application nozzles.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE DESIGNATIONS

1 application device
2 substrate
3 application chamber
4 supporting beam
5 clamping strip
6 foot strip
7 scraper bed
8 scraper element
9 retaining strip
10 limiting element
11 sealing plate
15 wearing body
17 surface of the wearing body
18 edge
20 bracket
21 bolt
22 incision
L direction of movement
M application medium

What is claimed is:

1. A device for applying a medium in the form of one of a liquid and a paste to a moving substrate, the substrate being one of a surface of a web of paper, a paper board, fibrous material and a transfer element, said device comprising:

an application chamber;

a first element associated with said application chamber on an output side of said application chamber in a direction of movement of the moving substrate;

a second element associated with an input side of said application chamber; and at least one limiting element associated with a lateral end of said application chamber, said at least one limiting element adjusting a width of application of the medium on the moving substrate, said at least one limiting element having a flexible sealing plate that substantially seals a space between the moving substrate, said first element and said second element, said sealing plate including a fitted wearing body that is directed toward the moving substrate, said wearing body being proximate to said first element and said second element, said wearing body including a face directed toward the moving substrate having one of an inclinded roof-like form such that said face includes two planar sections inclined toward the moving substrate as said face extends in a direction transverse to said direction of movement of the moving substrate and slot-shaped incisions, said wearing body having specific characteristics that are superior to the rest of said sealing plate, said specific characteristics being a greater resistance to wear, a greater dimensional stability, a greater resistance to heat, and a lower coefficient of friction.

2. The device of claim 1, wherein said first element is a scraper element and said second element is at least one of a retaining strip and an other scraper element.

3. The device of claim 1, wherein said wearing body is attached to said sealing plate by at least one of gluing, welding, screwing, riveting, pressing and molding.

4. The device of claim 1, wherein said sealing plate is made of at least one of rubber, cellular rubber and polyurethane, said wearing plate being made of at least one of thermoplastics, polyethylene, polyester, polymers, polyurethane, ceramics, rubber with graphite, bearing metals and bronze.

5. The device of claim 1, wherein said wearing body is interchangeable with an other wearing body.

6. The device of claim 1, wherein said face has an edge that is one of chamfered and rounded, said edge directed toward one of said first element and said second element.

7. The device of claim 1, wherein said first element is a circular cylindrical scraper bar, said second element is one of a scraper bar and a flat retaining strip.

* * * * *